US011169487B2

(12) United States Patent
Merino et al.

(10) Patent No.: US 11,169,487 B2
(45) Date of Patent: Nov. 9, 2021

(54) ANGULAR LOCKING SHOCKPROOF SYSTEM

(71) Applicant: ETA SA Manufacture Horlogere Suisse, Grenchen (CH)

(72) Inventors: Antonio Merino, Moutier (CH); Thierry Conus, Lengnau (CH); Ivan Villar, Bruegg (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 469 days.

(21) Appl. No.: 16/156,115

(22) Filed: Oct. 10, 2018

(65) Prior Publication Data

US 2019/0107810 A1 Apr. 11, 2019

(30) Foreign Application Priority Data

Oct. 10, 2017 (EP) ..... 17195675

(51) Int. Cl.
*G04B 37/05* (2006.01)
*G04B 31/04* (2006.01)

(52) U.S. Cl.
CPC ..... *G04B 37/052* (2013.01); *G04B 31/04* (2013.01)

(58) Field of Classification Search
CPC ..... G04B 37/052; G04B 31/004–0087; G04B 31/04
See application file for complete search history.

(56) References Cited

U.S. PATENT DOCUMENTS 2,233,743 A * 3/1941 Marti ..... G04B 31/04 368/324
2,973,618 A * 3/1961 Morf ..... G04B 31/04 368/326
3,712,051 A * 1/1973 Romang ..... G04B 31/04 368/326

(Continued)

FOREIGN PATENT DOCUMENTS

CH 296730 A * 2/1954 ..... G04B 31/04
CH 375288 A * 9/1963 ..... G04B 31/02

(Continued)

OTHER PUBLICATIONS

European Search Report dated Mar. 26, 2018 in European Application 17195675.8 filed on Oct. 10, 2017.

*Primary Examiner* — Daniel P Wicklund
(74) *Attorney, Agent, or Firm* — Oblon, McClelland, Maier & Neustadt, L.L.P.

(57) ABSTRACT

A shock-absorber device for a wheel arbor of a micromechanical device includes a support which includes a turning-arbor delimited by a rim defining a housing into which a pivot module is inserted. The pivot module includes a setting having a central orifice into which is inserted a bored stone. An endstone is placed on top of the bored stone. The shock-absorber device also includes a spring ring arranged between the support and the pivot module. The shock-absorber device is equipped with a bayonet system for mounting the spring ring. The bayonet system includes a peripheral shoulder under which is formed a circular groove which defines a holding area. The spring ring is equipped on an outer periphery with at least one catch. At least one first notch which leads to the circular groove is provided in the peripheral shoulder.

2 Claims, 6 Drawing Sheets

(56) References Cited

U.S. PATENT DOCUMENTS

| | | | | |
|---|---|---|---|---|
| 8,702,301 | B2 * | 4/2014 | Hiraoka | G04B 31/02 368/324 |
| 10,114,339 | B2 * | 10/2018 | Merino | G04B 37/052 |
| 2017/0261937 | A1 | 9/2017 | Merino | |

FOREIGN PATENT DOCUMENTS

| | | | |
|---|---|---|---|
| CH | 708 090 | A2 | 11/2014 |
| EP | 3 220 211 | A1 | 9/2017 |

* cited by examiner

ANGULAR LOCKING SHOCKPROOF SYSTEM

This application claims priority from European Patent Application No. 17195675.8 filed on Oct. 10, 2017, the entire disclosure of which is hereby incorporated herein by reference.

The present invention relates to a shock-absorber device also known as a shockproof system for a wheel arbor of a micromechanical device, in particular but not exclusively a timepiece movement. The shock-absorber device comprises a support wherein is provided a housing intended to receive a pivot system in order to hold with a predetermined clearance an arbor pivot-shank. The shock-absorber device further comprises elastic means arranged to exert on the pivot system at least one axial elastic return force.

The technical field of the invention is the technical field of fine mechanics.

TECHNOLOGICAL BACKGROUND OF THE INVENTION

The present invention relates to a shock-absorber device for an arbor arranged in a micromechanical mechanism, in particular in a mechanical or electromechanical timepiece movement. Such shock-absorber devices, also known as "shock-absorber bearing-blocks" or "shockproof systems" have been known for a long time by mechanical watch manufacturers. These shock-absorber devices are intended to enable an arbor to absorb the energy resulting from a shock, in particular from a lateral shock, by allowing same to move momentarily from the rest position thereof, and then return to this rest position under the effect of an elastic return force. It shall be understood that, in micromechanical mechanisms in general, and in timepiece movements in particular, the majority of arbors extend vertically with respect to the plane wherein such micromechanical mechanisms or timepiece movements extend. A timepiece movement may then be subjected essentially to two different types of shocks: either an axial shock, if the watch falls substantially flat on a surface; or a lateral shock, if the watch falls on the side of the middle. Of both types of shocks, the lateral shock is the most bothersome. Indeed, in the case of an axial shock, the resultant force of this shock is exerted substantially perpendicularly to the back of the watch, and therefore approximately parallel to the direction wherein extend the timepiece movement arbors. The risks of these arbors becoming uncoupled or breaking are therefore relatively limited. On the other hand, in the case of a lateral shock, the resultant force of the shock is exerted along a direction approximately perpendicular to the arbors, such that the risk of arbors coming out of the housing thereof and/or breaking is high.

To solve this problem, manufacturers of mechanical watches and other micromechanical mechanisms have thus proposed shock-absorber devices, also known as shockproof devices. In brief, such shock-absorber devices comprise a support wherein a base is devoid of a bottom to allow the passage of an arbor ending with a pivot-shank. The support receives a setting which is a part of generally annular shape and which holds in a staged manner a bored stone traversed by the pivot-shank of the arbor and an endstone. The assembly formed by the setting, the bored stone and the endstone is held elastically in the support by means of a spring element removably mounted on the support and which exerts on the endstone an elastic pressing force. Such shock-absorber devices are particularly marketed under the brand Incabloc®. As regards the spring element, it may particularly be made of brass or indeed with a spring steel such as the cobalt-chromium austenitic grade marketed under the brand Phynox©KL, and is conventionally obtained using blanking techniques.

In the event of axial shock, the bored stone, the endstone and the arbor move substantially perpendicularly to the bottom of the watch, against the elastic return force of the spring element which returns all this equipment to the rest position.

In the event of lateral shock, the arbor will be knocked out of alignment and will abut against the base of the support, which will cause off-centring of the bored stone and, subsequently, of the setting and the endstone. In this case also, the spring element returns all the elements to the equilibrium position thereof.

FIGS. 1 and 2 appended to the present patent application illustrate schematically a shock-absorber device which is currently used in timepieces available on the market. This shock-absorber device is described in detail in the European patent application registered under the number EP 16160124.0 on behalf of the Applicant.

Designated hereinafter by the general reference number 1, the shock-absorber device, or shockproof system, may particularly be mounted in an element of a timepiece movement such as a plate or a bridge. This shock-absorber device 1 particularly comprises a support 2 which is presented in the form of a turning-arbor 4 wherein a base 6 is devoid of a bottom and which is delimited at the periphery thereof by a first rim 8. It shall be noted that the turning-arbor 4 and the first rim 8 may be made from a single piece, or indeed be separate pieces assembled with one another.

On the side opposite the base 6 of the turning-arbor 4, the first rim 8 comprises a top surface 10 extended, on the inside of the turning-arbor 4, by an inner wall 12, and on the outside of the turning-arbor by an outer wall 14.

The first rim 8 defines with the turning-arbor 4 a housing 16 wherein a pivot module 18 is inserted. This pivot module 18 comprises a setting 20, i.e. a part comprising a circular central orifice 22 and a second rim 24 delimited by an outer lateral wall 26 and an inner lateral wall 28. In the circular central orifice 22 is inserted a bored stone 30, the diameter thereof corresponding to that of the circular central orifice 22. As regards the inner lateral wall 28 of the setting 20, it is equipped with a shoulder 32 on which is placed an endstone 34.

The pivot module 18 thereby arranged is placed in the housing 16 of the support 2, then the assembly thereby obtained is inserted, for example into an orifice of a timepiece plate or into one of the bridges of a timepiece movement. The pivot module 18 is arranged to engage with a pivot-shank 36 of an arbor 38.

The shock-absorber device 1 further comprises elastic means 40 envisaged to cooperate with the pivot module 18 so as to absorb shocks and return the pivot module 18 to the rest position thereof when the strain induced by the shocks recedes. These elastic means 40 are attached to the support 2 and are, preferably, also in contact with the pivot module 18.

In one embodiment given merely by way of example only, the elastic means 40 are presented in the form of a flat type spring ring 42, i.e. blanked in a strip or blade wherein a width is substantially greater than the thickness. This spring ring 42 is metallic and circular in shape, centred on a point C.

As can be seen upon examining FIGS. 1 and 2, the spring ring 42 comprises for example three evenly spaced arms 44 which extend radially towards the centre C of this spring ring 42. These three arms 44 enable the spring ring 42 to press the pivot module 18 in the housing 16 of the support 2.

For mounting the spring ring 42 on the support 2, a bayonet system 46 is used. This bayonet system 46 comprises a peripheral shoulder 48 which extends from the first rim 8 of the support 2 to the centre of this support 2. Moreover, a circular groove 50 is formed in the inner wall 12 of the first rim 8, under the peripheral shoulder 48, to define a holding area.

In order to engage with the bayonet system 46, the spring ring 42 is equipped on the periphery thereof with three evenly spaced catches 52 which extend radially away from the centre C of this spring ring 42. As can be seen in the drawing, each of these three catches 52 is arranged between two consecutive arms 44 of the spring ring 42. Voluntarily, the three catches 52 give the spring ring 42 an outer diameter which exceeds the inner diameter of the peripheral shoulder 48. Consequently, in order to enable the mounting of the spring ring 42 on the support 2, three first notches 54 opening into the circular groove 50 are provided in the peripheral shoulder 48. Subsequently, to mount the spring ring 42 on the support 2, it is simply necessary to present same such that the three catches 52 are engaged in the corresponding three first notches 54, and then pivoting same so as to enable the catches 52 to slide inside the circular groove 50, under the peripheral shoulder 48.

The notches 54 are typically formed by a forming operation of the peripheral shoulder 48 which brings out circular arc-shaped portions 55. At each of the ends of the circular arc-shaped portions 55, the material is pushed back locally during the forming operation, which forms hollows 57*a* on the top of these circular arc-shaped portions 55, and bosses 57*b* below the circular arc-shaped portions 55. These bosses 57*b* help holding the spring ring 52 when the latter is inserted into the circular groove 50, under the circular arc-shaped portions 55 of the peripheral shoulder 48.

It shall be noted that spring ring 42 is mounted after the step aimed at placing the pivot module 18 in the housing 16 thereof. When the spring ring 42 is fitted, the pivot module 18 exerts on this spring ring 42 a force tending to push back this spring ring 42. Under the effect of this strain, the spring ring 42 tends to be elastically deformed, but is not driven from the housing 16 due to the presence of the catches 52 inserted into the circular groove 50 which absorb the mechanical strain and oppose the movement of the spring ring 42. Furthermore, as the catches 52 define passive areas of the spring ring 42, the presence of these catches 52 and the mechanical strain absorbed thereby have no effect on the behaviour of the spring ring 42. Consequently, the behaviour of the spring ring 42 is not modified when the latter is mounted on the support 2.

As its name suggests, a shock-absorber device is intended to enable a micromechanical arbor, for example housed in a timepiece movement, to absorb without breaking the resultant energy of a shock, particularly a lateral shock, enabling said arbor to move momentarily under the effect of a shock before returning same elastically to the rest position thereof. According to the intensity of the shock and the direction along which it is applied, the spring ring 42 is nonetheless likely to pivot on itself and it is absolutely possible for it to be found in a scenario wherein the three catches 52 are presented in the corresponding three first notches 54. In such a scenario, the spring ring 42 may be uncoupled from the support 2. The arbor 38 is then no longer secured by the shock-absorber device 1, which inevitably leads to the failure of the mechanical device, for example of a timepiece, wherein is fitted this shock-absorber device 1. Such a risk is even less acceptable given that, in the field of watchmaking in particular, the shock-absorber devices are mostly fitted in watches belonging to the upper segment of the market.

In order to remedy this problem, it was previously proposed in the patent application EP 16160124.0 mentioned above to spot-face the peripheral shoulder 48 in the areas situated between two successive notches 54. The term spot-facing denotes the action of straightening the bottom surface of the peripheral shoulder 48 by removing material by means of a rotary blade. By means of this spot-facing action, it is possible to partially reduce the thickness of a third rim 56 of the peripheral shoulder 48 and create, between two successive notches 54, countersinks 58 wherein the catches 52 are housed.

The above solution did not prove to be fully satisfactory. Firstly, the clearances 58 wherein are housed the catches 52 proved to be of insufficient depth and the peripheral rims thereof of insufficient height to be able to ensure satisfactory angular pivot locking of the spring ring 42 in the event of shocks, particularly in the case of lateral shocks. Furthermore, machining the clearances 58 using a milling-cutter, usually a T type milling-cutter, proved to be extremely time-consuming, tedious and with unpredictable results. During the machining operations, it was necessary in particular to take care not to cut into the inner diameters of the peripheral shoulder 48. The feed rate of the T milling-cutter was low and vibrations occurred in the milling tool. Finally, in spite of all the care taken in the milling operations, it was not uncommon for burrs to remain in the countersinks 58.

SUMMARY OF THE INVENTION

The aim of the present invention is that of resolving the problems mentioned above as well as others by proposing a shock-absorber device wherein the risks of the various components thereof becoming uncoupled in the event of axial or lateral shock are reduced considerably, or even eliminated.

To this end, the present invention relates to a shock-absorber device for a wheel arbor of a micromechanical device, particularly a timepiece movement, this shock-absorber device comprising a support which includes a turning-arbor a base thereof being devoid of a bottom and which is delimited at the periphery thereof by a rim, the rim comprising a top surface extended, on the inside of the turning-arbor, by an inner wall, and, on the outside of the turning-arbor, by an outer wall, the rim of the turning-arbor defining a housing into which a pivot module is inserted, this pivot module comprising a setting having a central orifice into which is inserted a bored stone which corresponds in shape and in size to those of the central orifice, an endstone being placed on the setting, on top of the bored stone, the shock-absorber device also comprising a spring ring arranged between the support and the pivot module to exert elastic strain on this pivot module, the shock-absorber device being equipped with a bayonet system for mounting the spring ring between the support and the pivot module, this bayonet system comprising a peripheral shoulder which extends from the inner wall of the rim towards the inside of the support, and under which is formed a circular groove which defines a holding area, the spring ring being equipped on an outer periphery with at least one catch which gives this spring ring an outer diameter which exceeds the inner diameter of the peripheral shoulder, at least one first notch which leads to the circular groove being provided in the peripheral shoulder, this first notch defining a first diameter at least equal to the outer diameter of the spring ring, such that it is simply necessary to present the spring ring in such a way that the catch is engaged in the corresponding first notch, and then pivoting the spring ring so as to enable the catch to slide inside the circular groove, under the peripheral shoulder, wherein at least one second notch is machined in the peripheral shoulder, this second notch defining a second diameter less than the outer diameter of the spring ring, such that the catch is interlocked in this second notch, ensuring the angular pivot locking of the spring ring.

As a result of these features, the present invention provides a shock-absorber device with second notches blanked in the rim of the peripheral shoulder. As such, a departure is made from the circular profile of the rim of the peripheral shoulder, which enables the catches of the spring ring to adopt a position of lower strain under the bottom surface of the peripheral rim, and abut against the edges delimiting the profile of these second notches. The spring ring is thereby locked in angular pivoting, which helps ensure that in the event of a shock, particularly lateral, the risks of the wheel arbors becoming uncoupled are limited, or even zero. A further advantage of the invention lies in that the notches are very easy to machine, for example by stamping or blanking. Production times are therefore considerably reduced and the rejection rates of the support parts are very low, which all help lower the cost price of the shock-absorber devices according to the invention substantially. Finally, given that the notches are very easy to machine in the peripheral shoulder, the profile of the second notches may be varied almost ad infinitum, which makes it possible to seek a profile which, for a given geometry of the various elements of the shock-absorber device, makes it possible to obtain optimal locking and response of the spring ring in the event of shock.

BRIEF DESCRIPTION OF THE FIGURES

Further features and advantages of the present invention will emerge more clearly from the following detailed description of an embodiment of a shock-absorber device according to the invention, this example being given merely by way of illustration and not limitation with reference to the appended figure wherein.

DETAILED DESCRIPTION OF AN EMBODIMENT OF THE INVENTION

The present invention proceeds from the general inventive idea which consists of blanking in the rim of the peripheral shoulder of the support of a shock-absorber device notches intended to receive the locking catches of a spring ring intended to constrain the endstone towards the bored stone which guides the pivot-shank of a wheel arbor. These notches, for example formed by stamping or blanking, are easier to machine, such that the cost price of the resulting supports is lower than previously. Moreover, given that the notches are blanked in the full thickness of the rim, the locking of the catches against the edges which delimit the profile of these notches is optimal. Finally, due to the ease with which these notches may be produced, great freedom is enjoyed with respect to the shape that may be given to these notches, which, for each spring ring geometry, makes it possible to seek the notch shape ensuring optimal blocking of this spring ring.

Figure 1:
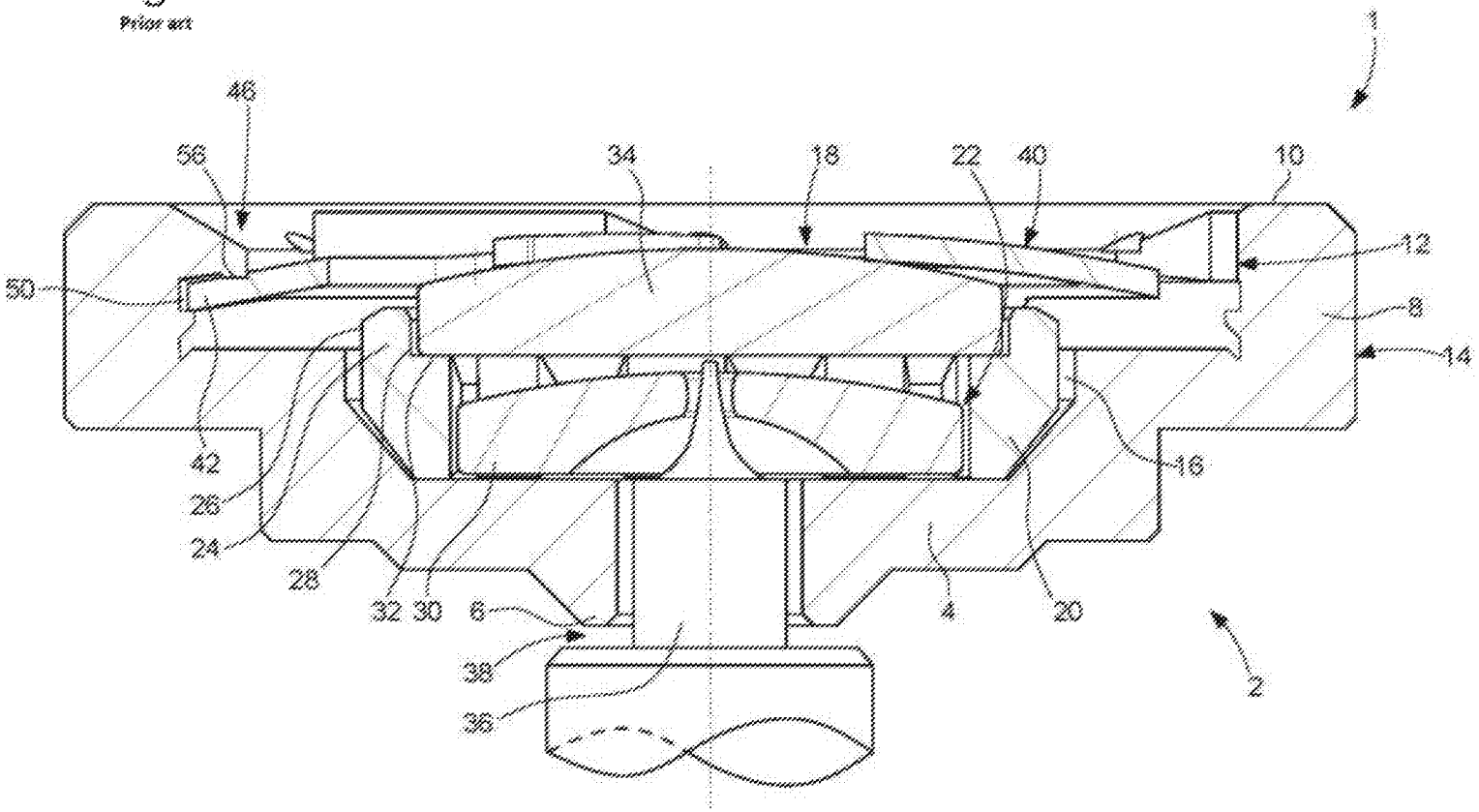
Fig. 1 Prior art
FIGS. 1 and 2, cited above, illustrate schematically a known shock-absorber device wherein hollows are machined in the bottom surface of the peripheral shoulder of the support, so as to try to lock the spring ring in angular pivoting in the event of a shock.
Figure 2:
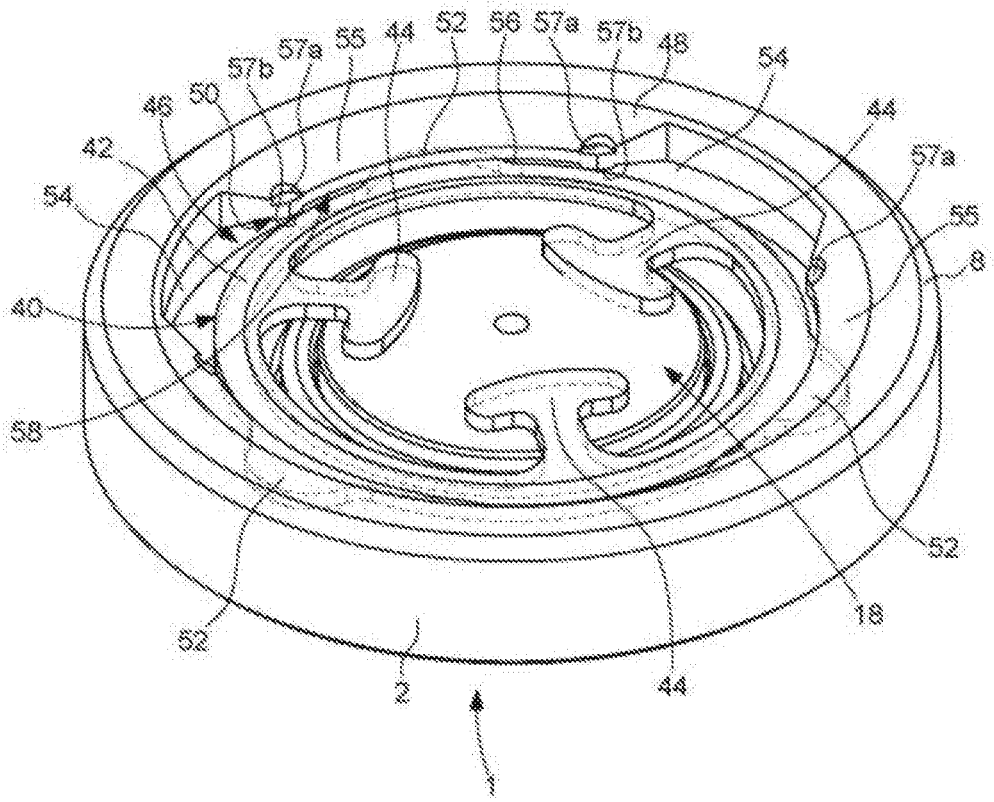
Fig. 2 Prior Art

The shock-absorber device according to the invention is in all respects identical to the shock-absorber device of the prior art described above, with the noteworthy difference that the rim of the peripheral shoulder of the support is partially blanked along notches which enable locking of the catches of the spring ring, and therefore angular pivot locking thereof. It will therefore be understood that, hereinafter, identical elements to those described with reference to FIGS. 1 and 2 will be designated with the same reference numbers.

Figure 3A:
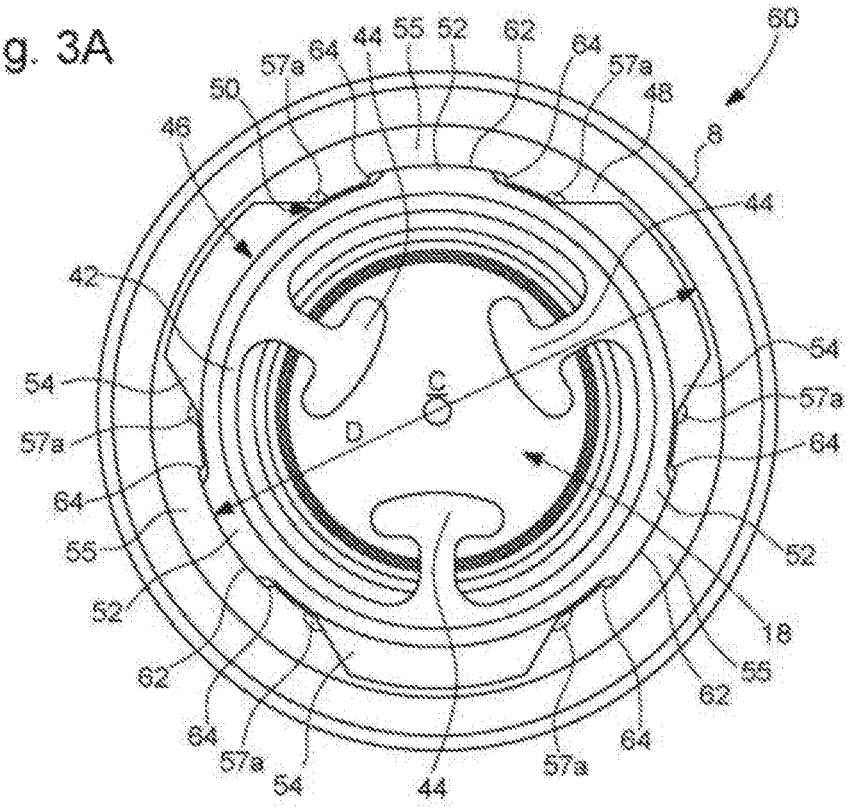
FIGS. 3A and 3B are top and perspective views respectively of a shock-absorber device according to a first embodiment of the invention.
Figure 3B:
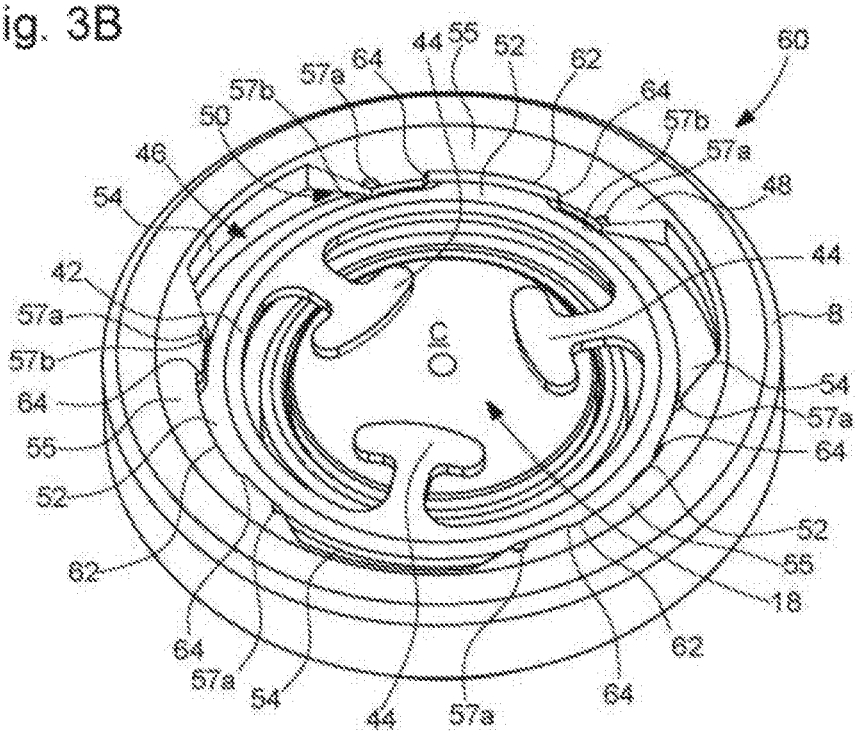

FIGS. 3A and 3B illustrate, in a top and perspective view respectively, a first embodiment of a shock-absorber device according to the invention. Designated as a whole by the general reference number 60, this shock-absorber device particularly comprises a flat type spring ring 42 provided with at least one and, in the example shown, three evenly spaced arms 44 which extend radially towards the centre C of this spring ring 42. These three arms 44 enable the spring ring 42 to press the pivot module 18 in the housing 16 of the support 2.

For mounting the spring ring 42 on the support 2, a bayonet system 46 is used which comprises a peripheral shoulder 48 extending from the first rim 8 of the support 2 towards the centre of this support 2. Moreover, a circular groove 50 is formed in the inner wall 12 of the first rim 8, under the peripheral shoulder 48, to define a holding area.

In order to engage with the bayonet system 46, the spring ring 42 is equipped on the outer periphery thereof with at least one and, in the example shown, three evenly spaced catches 52 which extend radially away from the centre C of this spring ring 42. As can be seen in the figure, these three catches 52 are arranged in an angularly offset manner with respect to the three arms 44 of the spring ring 42, preferably at equal angular distance from two consecutive arms 44.

Voluntarily, the three catches 52 give the spring ring 42 an outer diameter which exceeds the inner diameter D of the peripheral shoulder 48. Consequently, to enable mounting of the spring ring 42 on the support 2, it is provided in the peripheral shoulder 48 first notches 54, three in number, which lead to the circular groove 50. These three first notches 54 are arranged with the same angular spacing as the catches 52. Subsequently, to mount the spring ring 42 onto the support 2, it is simply necessary to present same such that the three catches 52 are situated facing the corresponding three first notches 54, then pivoting same so as to enable the catches 52 to slide inside the circular groove 50, under the peripheral shoulder 48.

The notches 54 are typically formed by a forming operation of the peripheral shoulder 48 which brings out circular arc-shaped portions 55. At each of the ends of the circular arc-shaped portions 55, the material is pushed back locally during the forming operation, which forms hollows 57*a* on the top of these circular arc-shaped portions 55, and bosses 57*b* below the circular arc-shaped portions 55. These bosses 57*b* help hold the spring ring 42 when the latter is inserted into the circular groove 50, under the circular arc-shaped portions 55 of the peripheral shoulder 48.

It shall be noted that the spring ring 42 is mounted after the step aimed at placing the pivot module 18 in the housing 16 thereof. When the spring ring 42 is fitted, the pivot module 18 exerts on this spring ring 42 a force tending to push back this spring ring 42. Under the effect of this strain, the spring ring 42 tends to be elastically deformed, but is not driven from the housing 16 due to the presence of the catches 52 inserted into the circular groove 50 which absorb the mechanical strain and oppose the movement of the spring ring 42. Furthermore, as the catches 52 define passive areas of the spring ring 42, the presence of these catches 52 and the mechanical strain absorbed thereby have no effect on the behaviour of the spring ring 42. Consequently, the behaviour of the spring ring 42 is not modified when the latter is mounted on the support 2.

In order to ensure the angular pivot locking of the spring ring 42 and thereby ensure that the shock-absorber device 60 is not liable to become uncoupled in the event of a shock, second notches 62, three in number, are machined, for example by blanking or stamping, in the third rim 56 of the peripheral shoulder 48 of the support 2. As such, once the spring ring 42 is engaged in the circular groove 50 of the bayonet system 46, it is simply necessary to pivot the spring ring 42 until the catches 52 interlock in the second notches 62 abutting against the edges 64 which delimit the profile of these second notches 62.

Figure 6A:
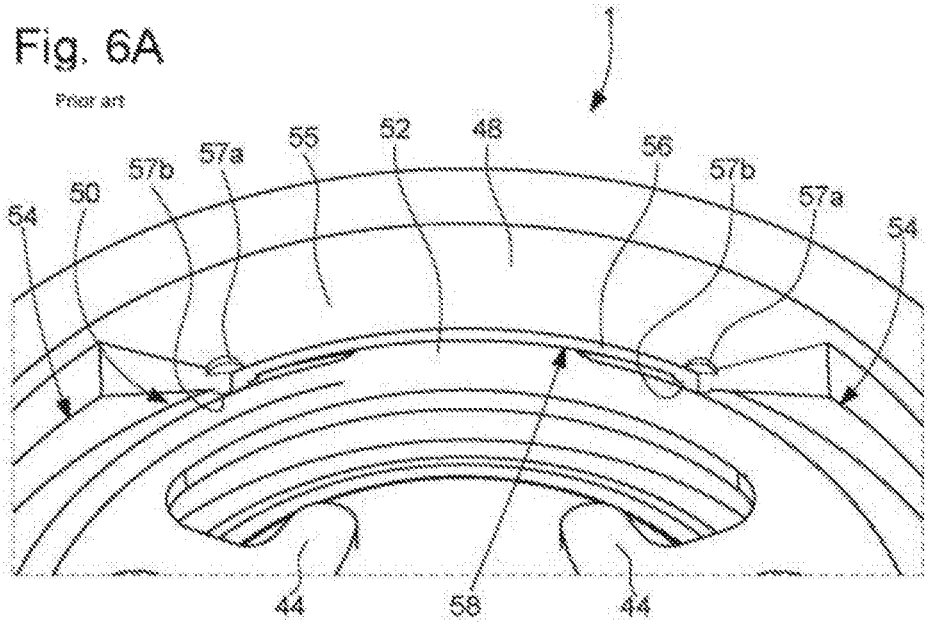
Fig. 6A Prior art
FIG. 6A is a large-scale detailed view of the region of the support according to the prior art wherein the peripheral shoulder is provided with clearances which receive the catches of the spring ring.
Figure 6B:
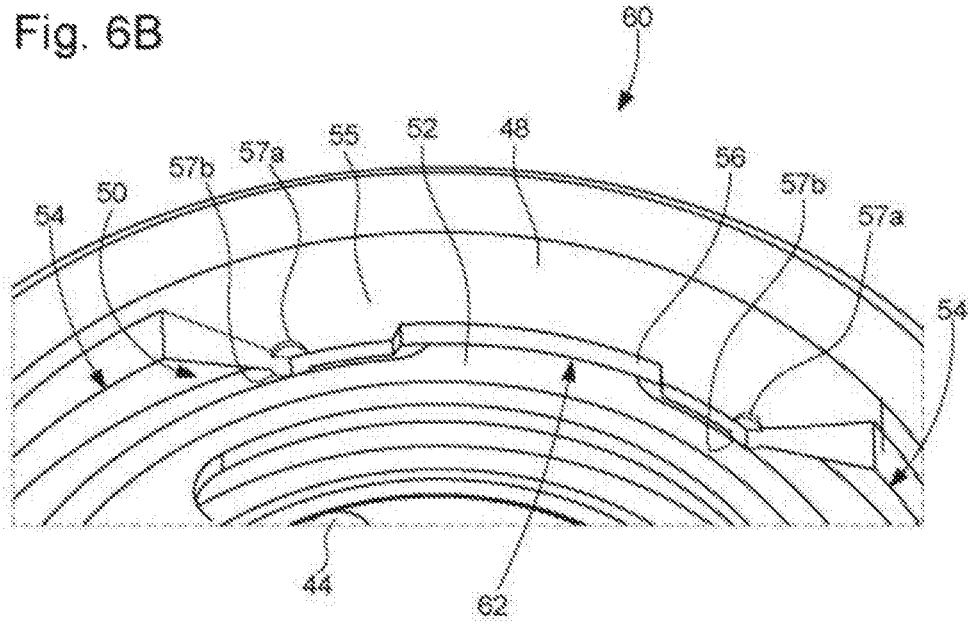
FIG. 6B is a large-scale detailed view of the region of the support according to the invention wherein the peripheral shoulder is provided with notches which receive the catches of the spring ring.

On studying FIGS. 6A and 6B, it is observed that, in the case of the shock-absorber device 1 of the prior art (FIG. 6A), the thickness of the third rim 56 of the peripheral shoulder 48 is only reduced by the bottom, without altering the perimeter of these rim 56, to create clearances 58. However, it is easily understood that such a machining operation is time-consuming and difficult to carry out. Moreover, the clearances 58 proved to be of insufficient depth and the peripheral rims thereof of insufficient height to be able to ensure satisfactory angular pivot locking of the spring ring 42 in the event of shocks. On the other hand, in the case of the shock-absorber device 60 according to the invention (FIG. 6B), the second notches 62 are blanked in the third rim 56 of the peripheral shoulder 48 of the support 2, on the entire thickness of this third rim 56 and cutting into the perimeter of this third rim 56. As such, these second notches 62 are of sufficient depth and the edges 64 thereof of sufficient height to ensure satisfactory locking of the catches 52 and angular pivot locking of the spring ring 42 in the event of a shock.

Figure 4A:
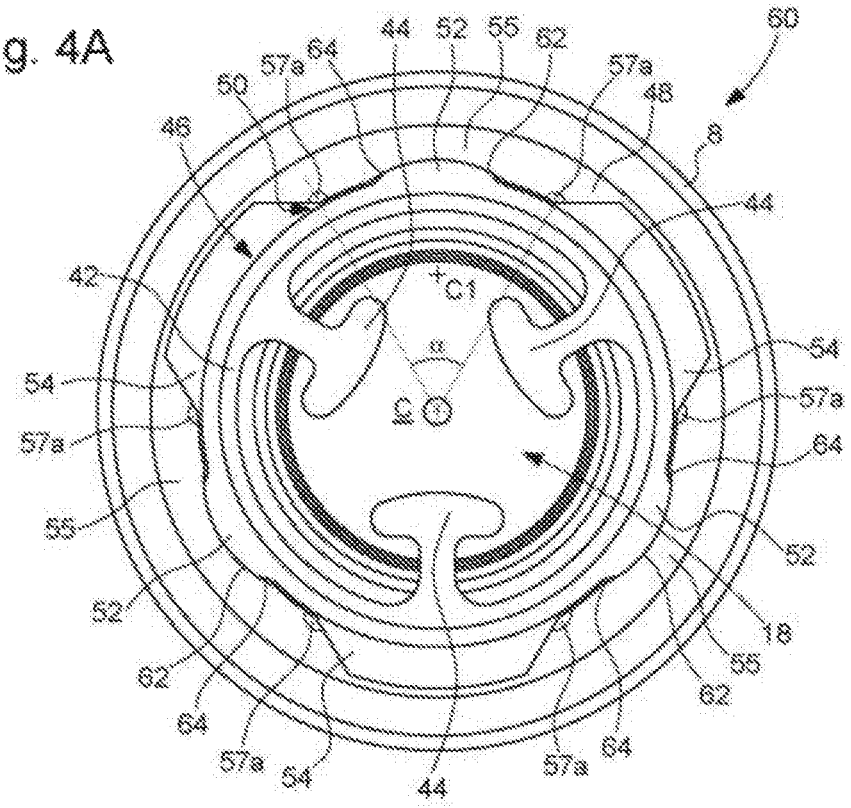
FIGS. 4A and 4B are top and perspective views respectively of a shock-absorber device according to a second embodiment of the invention.
Figure 4B:
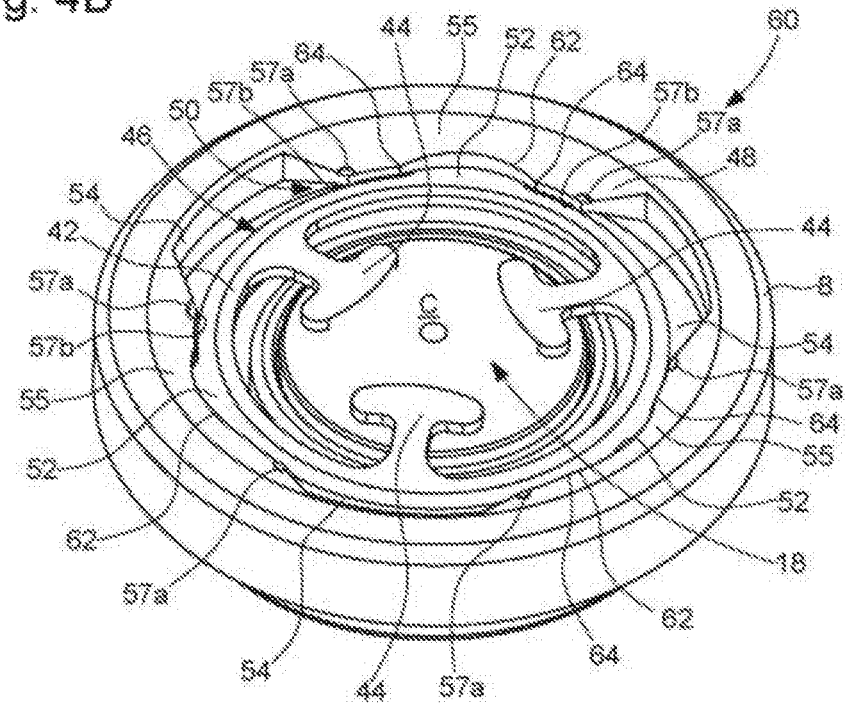
Figure 5A:
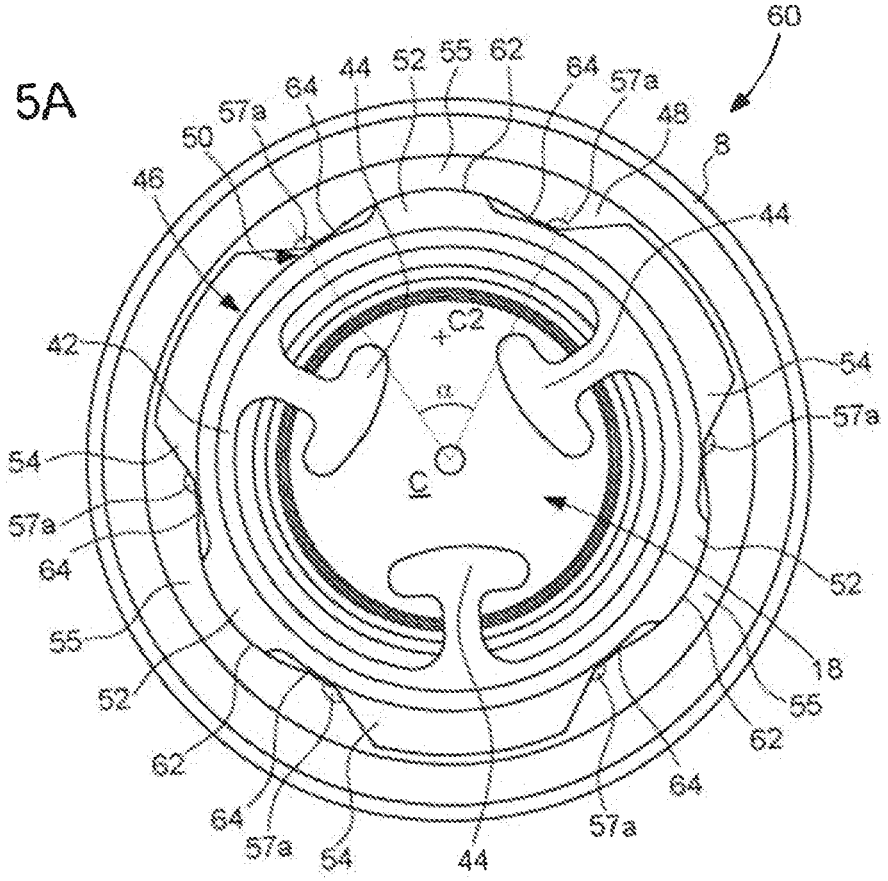
FIGS. 5A and 5B are top and perspective views respectively of a shock-absorber device according to a third embodiment of the invention.
Figure 5B:
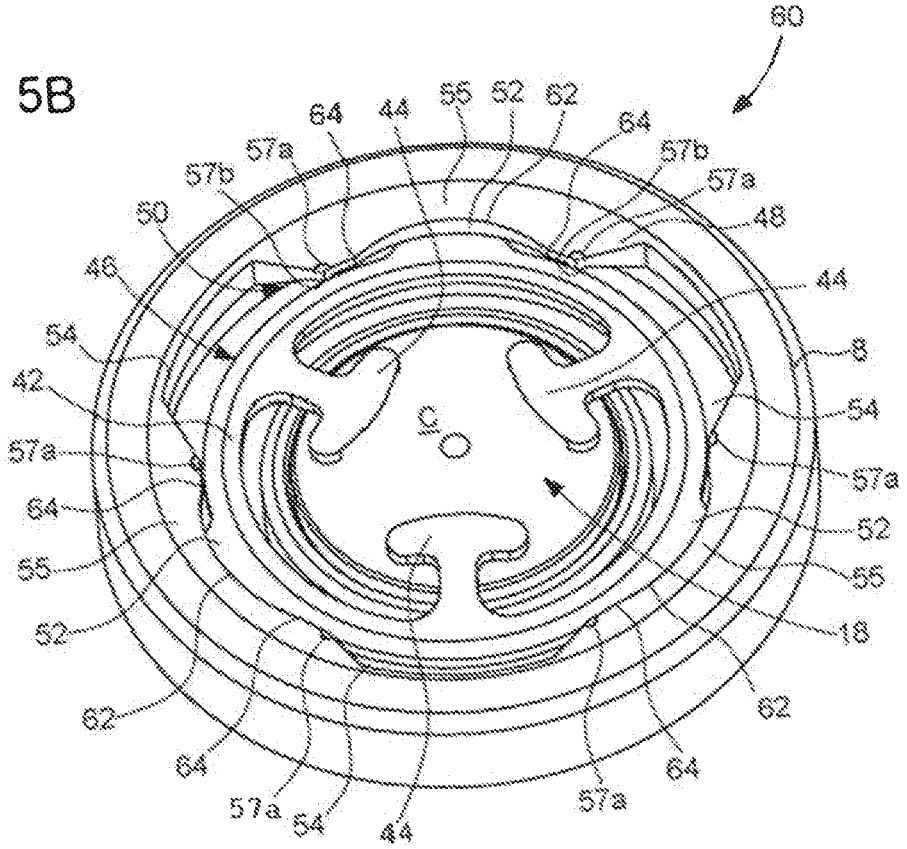

Moreover, these second notches 62 are very easy to machine and it is therefore possible to optimally adapt the profile thereof to ensure optimal locking. As such, in FIGS. 3A and 3B, the perimeter 56 of the peripheral shoulder 48 has been cut into to form notches 62 which extend along circular arcs which are concentric with the centre C of the spring ring 42. In FIGS. 4A and 4B, the second notches 62 were obtained by blanking the peripheral shoulder 48 along a circle of small radius wherein the centre C1 is situated on the bisector of the angle $\alpha$ which extends between two successive first notches 54. Similarly, in FIGS. 5A and 5B, the second notches 62 were obtained by blanking the peripheral shoulder along a circle of larger radius wherein the centre C2 is also situated on the bisector of the angle which extends between two successive first notches 54.

It is obvious that the present invention is not restricted to the embodiments described above, and that various modifications and simple alternative embodiments may be envisaged by those skilled in the art without leaving the scope of the invention as defined by the appended claims.

REFERENCE LIST

1. Shock-absorber device or shockproof system
2. Support
4. Turning-arbor
6. Base
8. First rim
10. Top surface
12. Inner wall
14. Outer wall
16. Housing
18. Pivot module
20. Setting
22. Circular central orifice
24. Second rim
26. Outer lateral wall
28. Inner lateral wall
30. Bored stone
32. Shoulder
34. Endstone
36. Pivot-shank
38. Arbor
40. Elastic means
42. Spring ring
C. Centre of spring ring
44. Arm
46. Bayonet system
48. Peripheral shoulder
50. Circular groove
52. Catches
54. First notches
55. Circular-arc portions
56. Third rim
57*a*. Hollows
57*b*. Bosses
58. Clearances
60. Shock-absorber device
62. Second notches
64. Edges

What is claimed is:

1. A shock-absorber device for a wheel arbor of a micromechanical device, wherein said shock-absorber device comprises a support which includes a turning-arbor a base thereof being devoid of a bottom and which is delimited at the periphery thereof by a rim, wherein the rim comprises a top surface extended, on the inside of the turning-arbor, by an inner wall, and, on the outside of the turning-arbor, by an outer wall, wherein the rim of the turning-arbor defines a housing into which a pivot module is inserted, wherein said pivot module comprises a setting having a central orifice into which a bored stone which corresponds to a shape and a size of the central orifice is inserted, wherein an endstone is placed on the setting, on top of the bored stone, wherein the shock-absorber device also comprises a spring ring arranged between the support and the pivot module to exert elastic strain on said pivot module, wherein the shock-absorber device is equipped with a bayonet system for mounting the spring ring between the support and the pivot module, wherein said bayonet system comprises a peripheral shoulder which extends from the inner wall of the rim towards the inside of the support, and under which is formed a circular groove which defines a holding area, wherein the spring ring is equipped on an outer periphery with at least one catch which gives said spring ring an outer diameter which exceeds the inner diameter of the peripheral shoulder, wherein at least one first notch which leads to the circular groove is provided in the peripheral shoulder, wherein said first notch defines a first diameter at least equal to the outer diameter of the spring ring, such that the spring ring is presented in such a way that the catch is engaged in the corresponding first notch, and then pivoting the spring ring so as to enable the catch to slide inside the circular groove, under the peripheral shoulder, wherein at least one second notch is machined in the peripheral shoulder, wherein said second notch defines a second diameter less than the outer diameter of the spring ring, such that the catch is interlocked in said second notch, ensuring the angular pivot locking of the spring ring.

2. The shock-absorber device of claim 1, wherein the micromechanical device is a timepiece movement.

* * * * *